United States Patent [19]

Frauenfeld

[11] 4,025,362

[45] May 24, 1977

[54] APPARATUS FOR CLEANING THE HEAT EXCHANGING SURFACES OF THE HEAT TRANSFER PLATES OF ROTARY REGENERATIVE HEAT EXCHANGERS

[75] Inventor: Martin Frauenfeld, Heidelberg, Germany

[73] Assignee: Svenska Rotor Maskiner Aktiebolag, Nacka, Sweden

[22] Filed: Mar. 31, 1976

[21] Appl. No.: 672,427

[30] Foreign Application Priority Data

Apr. 1, 1975 Germany ..... 2514173

[52] U.S. Cl. ..... 134/57 R; 134/81; 134/152; 134/171; 134/172; 165/95

[51] Int. Cl.[2] ..... B08B 3/02; B08B 9/00

[58] Field of Search ..... 134/57 R, 80–81, 134/152, 167 R, 171, 172; 165/95

[56] References Cited

UNITED STATES PATENTS

| | | | |
|---|---|---|---|
| 2,069,574 | 2/1937 | Bowers | 134/171 X |
| 3,225,777 | 12/1965 | Shelton et al. | 134/152 X |
| 3,724,354 | 4/1973 | Smith | 134/57 R |
| 3,942,545 | 3/1976 | Flynn | 134/80 X |

FOREIGN PATENTS OR APPLICATIONS

| | | | |
|---|---|---|---|
| 2,031,936 | 1/1972 | Germany | 134/172 |
| 489,244 | 7/1938 | United Kingdom | 134/80 |

*Primary Examiner*—Robert L. Bleutge
*Attorney, Agent, or Firm*—Flynn & Frishauf

[57] ABSTRACT

Apparatus for cleaning the heat exchanging surfaces of the heat transfer plates of rotary regenerative heat exchangers by using a row of high pressure directional jets of cleaning fluid directed into the interspaces between the plates and hitting deposits positioned in the interspaces essentially in the shape of a moving row of impact points.

13 Claims, 2 Drawing Figures

FIG. 2
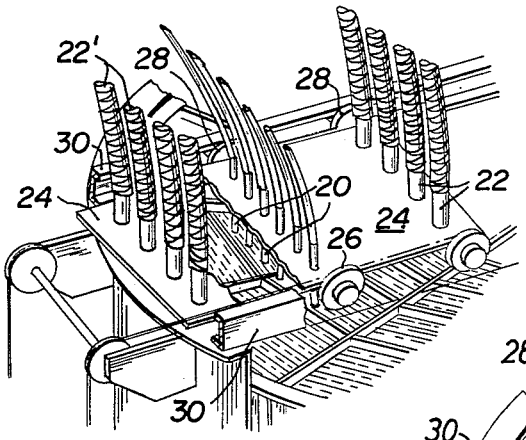
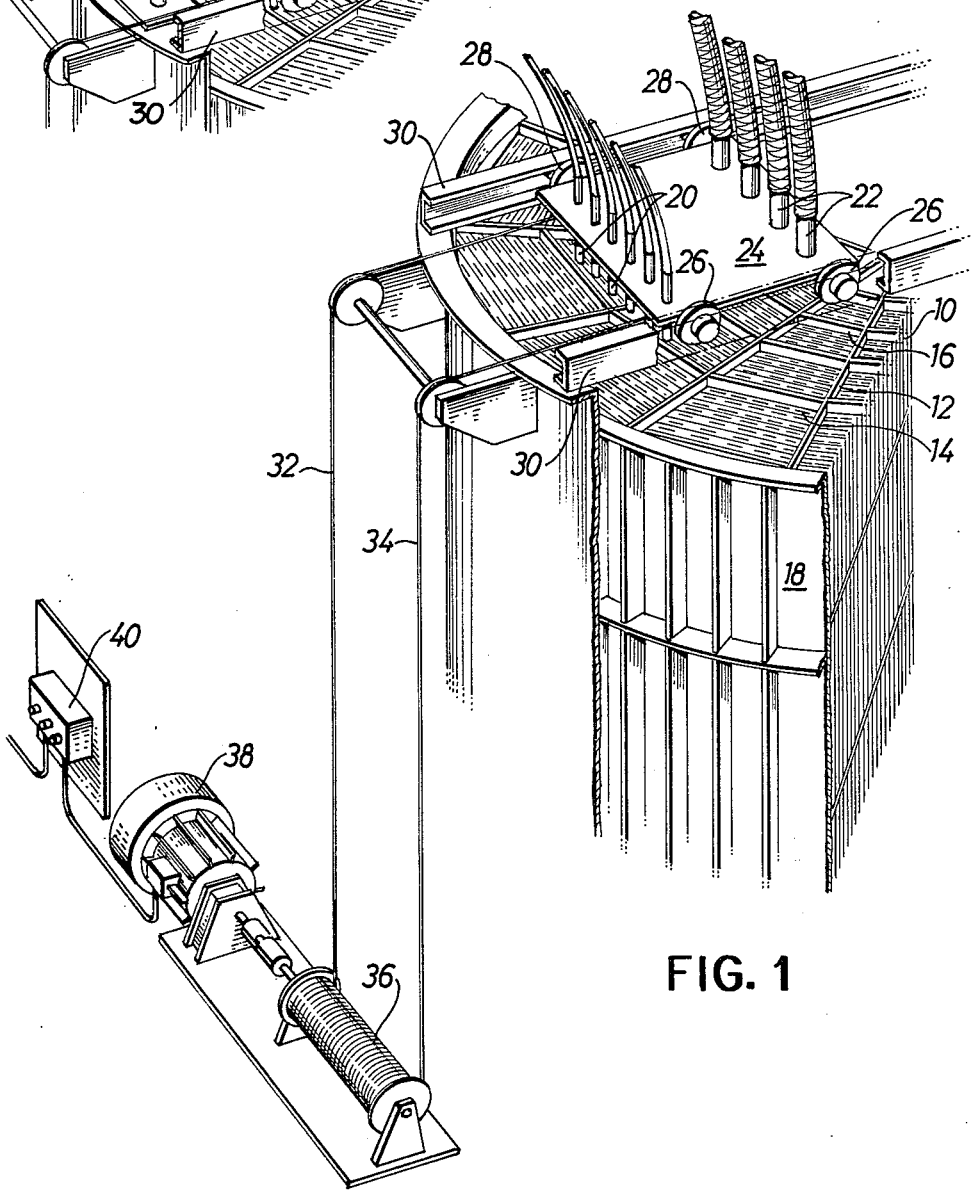
FIG. 1

APPARATUS FOR CLEANING THE HEAT EXCHANGING SURFACES OF THE HEAT TRANSFER PLATES OF ROTARY REGENERATIVE HEAT EXCHANGERS

This invention relates to a method and means for cleaning the heat exchanging surfaces of the heat transfer plates of rotary regenerative heat exchangers by directing directional jets of a cleaning fluid towards the heat exchanging surfaces.

Cleaning of the heat transfer elements of rotary regenerative heat exchangers after various operating time periods in dependence on the operating conditions, especially the type of fuel and the boiler load, usually is performed by means of different types of cleaning agents, as for instance steam, water and air. The cleaning usually has been carried out in the exhaust gas stream. Wet depositing of saturated steam and water, however, increases due to the formation of water containing aggressive solutions the at the so called cold end of the heat exchangers at which end fresh air is introduced and exhaust gases are discharged from the heat exchanger.

A great number of methods have been suggested in order to increase the cleaning effect of steam and/or compressed air on the surfaces of the heat transfer plates. German patent specification 956,971 (corresponding to U.S. Pat. No. 2,766,969), for example, discloses a cleaning device comprising a tube provided with a great number of apertures or nozzles which is positioned in an interspace between two layers of heat transfer elements.

Cleaning devices for regenerative heat exchangers of the type having stationary heat transfer elements and rotating air and gas ducts are also known. Such known devices generally comprise nozzles movable step by step in pairs in a circular path together with the rotating hubs of the heat exchanger.

By using a single nozzle or pairs of nozzles, cleaning jets of very high intensity can be obtained utilizing a pressure of up to 14 kp/cm² and 17.6 kp/cm² in connection with saturated steam and compressed air, respectively, which improves the cleaning effect on fixedly attached deposits on the surfaces of the heat transfer plates but often give rise to considerable damages of the heat transfer plates.

The object of the present invention is to provide an improved cleaning apparatus by means of which fixedly attached deposits can be removed in a simple manner and the above mentioned drawbacks can be avoided.

SUMMARY OF THE INVENTION

According to the present invention, apparatus for cleaning heat exchanging surfaces of heat transfer plates of a rotary regenerative heat exchanger comprises a plurality of cleaning fluid nozzles directed toward the heat transfer plates, the nozzles being positioned adjacent each other on at least one line and essentially in parallel to the planes of the heat transfer plates, and means for displacing the nozzles relative to the planes of the plates. The nozzles are each dimensioned to produce a directional output jet of high kinetic energy and are further dimensioned to have a sectional area that at least perpendicular to the planes of the heat transfer plates essentially does not increase in size. A cleaning liquid source is coupled to the nozzles for supplying a high pressure cleaning liquid to the cleaning fluid nozzles sequentially in groups of at least one nozzle.

The invention will be described more in detail in the following part of the specification in connection with a preferred embodiment of a cleaning device according to the invention shown in the accompanying drawing.

BRIEF DESCRIPTION OF THE DRAWINGS

FIG. 1 is a fragmentary perspective view of a rotary regenerative heat exchanger having the major part of its housing omitted; and FIG. 2 is a partial showing of a modification to the embodiment of FIG. 1.

DETAILED DESCRIPTION

The rotary regenerative heat exchanger shown in FIG. 1 comprises a great number of undulated and/or notched tangential heat transfer plates 10 supported in a number of layers by a rotor comprising radial walls 12, radial and tangential partition walls 14 and 16, respectively, and an enclosing outer shell 18. A row of high-pressure cleaning nozzles 20, and behind said cleaning nozzles a row of low-pressure washing nozzles 22, are supported by a carriage 24 provided with wheels 26, 28 guided by two fixed rails 30 having a U-shaped cross section. The carriage 24 is movable along said rails 30 by means of two ropes 32, 34 operated by a winch 36 driven by an electric motor 38 which in turn is operated by a control device 40.

The carriage 24 is moved radially inwardly and outwardly along the rails 30 and the cleaning nozzles 20 are supplied with a cleaning liquid, preferably water with added anti-corrosion and other usual agents, under a pressure of 200 to 400 at. The nozzles 20 form liquid jets of high kinetic energy and each jet has a cylindrical or flat sectional area that does not increase essentially in a plane perpendicular to the plane of said heat transfer plates. It is very surprising that the high pressure jets do not impart vibrations followed by damage to the plates 10. This is due to the act that the jets hit the deposits attached to the plates 10 at points which slowly are moved over the surface of the plates. After the deposits have been more or less loosened they are washed away by the washing jets of lower energy acting during a longer time period produced by washing nozzles 22 located behind cleaning nozzles 20.

In order to achieve a uniform treatment of all parts of the heat transfer elements the control device 40 is designed to control the velocity of the carriage 24 (moved continuously or step-by-step) in response to the actual circumferential velocity of the heat transfer plates 10 just being cleaned. The circumferential velocity of the plates 10 near the outer shell 18 is comparatively high and, thus, when the carriage 24 is positioned above said plates its mean velocity is reduced with respect hereto.

As shown in FIG. 2 the carriage 24 is preferably provided with a further row of washing nozzles 22' so that the row of cleaning nozzles 20 always is followed by a trailing row of washing nozzles.

What is claimed is:

1. Apparatus for cleaning the heat exchanging surfaces of the heat transfer plates of a rotary regenerative heat exchanger comprising:

a plurality of cleaning fluid nozzles (20) directed towards the heat transfer plates, said nozzles (20) being positioned adjacent each other on at least one line and essentially in parallel to the planes of the heat transfer plates;

means for displacing said nozzles (20) relative to the planes of said plates;

said nozzles (20) each being dimensioned to produce a directional output jet of high kinetic energy and with a sectional area that at least perpendicular to the planes of said heat transfer plates essentially does not increase in size; and a cleaning liquid source coupled to said nozzles (20) for supplying said cleaning fluid nozzles (20) sequentially in groups of at least one nozzle with a high pressure cleaning liquid.

2. A device as claimed in claim 1, further comprising:

washing nozzles (22) movably arranged behind said cleaning fluid nozzles (20), said washing nozzles (22) being dimensioned and arranged to pass a larger amount of fluid than said cleaning fluid nozzles (20); and a washing fluid source coupled to said washing nozzles (22) for supplying the washing nozzles (22) with a washing fluid of lower pressure than the pressure of the cleaning fluid supplied to said cleaning fluid nozzles (20).

3. A device as claimed in claim 2, wherein said washing nozzles (22) are positioned before and behind said cleaning fluid nozzles (20), and further comprising a coupling device arranged to selectively connect said washing nozzles (22) which are positioned behind said cleaning fluid nozzles (20) to said washing fluid source in response to the direction of movements of the nozzles.

4. A device as claimed in claim 2, wherein said displacing means includes a carriage (24) supporting said cleaning fluid nozzles (20), said carriage (24) being movable substantially perpendicular to the planes of said heat transfer plates (10).

5. A device as claimed in claim 4 wherein said carriage (24) further supports said washing nozzles (22).

6. A device as claimed in claim 5, further comprising:

motor driven means (32–38) coupled to said carriage (24) for displacing said carriage; and a control device (40) coupled to said motor driven means (32–38) for actuating said motor driven means in response to the actual circumferential velocity of the heat transfer plates just being cleaned.

7. A device as claimed in claim 2, further comprising additional washing nozzles on the side of said cleaning fluid nozzles opposite to that of said first-mentioned washing nozzles, said additional washing nozzles being coupled to said washing fluid source.

8. A device as claimed in claim 1, wherein said displacing means includes a carriage (24) supporting said cleaning fluid nozzles (20), said carriage (24) being movable substantially perpendicular to the planes of said heat transfer plates (10).

9. A device as claimed in claim 8, further comprising:

motor driven means (32–38) coupled to said carriage (24) for displacing said carriage; and a control device (40) coupled to said motor driven means (32–38) for actuating said motor driven means in response to the actual circumferential velocity of the heat transfer plates just being cleaned.

10. A device as claimed in claim 1, wherein said cleaning fluid nozzles (20) produce cylindrical directional cleaning fluid jets.

11. A device as claimed in claim 1, wherein said cleaning fluid nozzles (20) produce flat directional cleaning fluid jets.

12. A device as claimed in claim 1, wherein each of said groups of cleaning fluid nozzles (20) comprises a single one of said nozzles (20).

13. A device as claimed in claim 1, wherein each of said groups of cleaning fluid nozzles comprises a plurality of said nozzles (20).

* * * * *